US005979570A

United States Patent [19]

McLoughlin et al.

[11] Patent Number: 5,979,570

[45] Date of Patent: Nov. 9, 1999

[54] SURFACE CONTROLLED WELLBORE DIRECTIONAL STEERING TOOL

[76] Inventors: Stephen John McLoughlin, 36 Wychwood Close, Bognor Regis, West Sussex, PO21 4DW, United Kingdom; Jack Philip Chance, Flat 2, 62A New Nirco, Digla-Naadi, Cario, Egypt

[21] Appl. No.: 08/930,563

[22] PCT Filed: Apr. 1, 1996

[86] PCT No.: PCT/GB96/00813

§ 371 Date: Oct. 2, 1997

§ 102(e) Date: Oct. 2, 1997

[87] PCT Pub. No.: WO96/31679

PCT Pub. Date: Oct. 10, 1996

[30] Foreign Application Priority Data

Apr. 5, 1995 [GB] United Kingdom ..... 9507008

[51] Int. Cl.[6] ..... E21B 7/08

[52] U.S. Cl. ..... 175/24; 175/45; 175/73

[58] Field of Search ..... 175/24, 26, 45, 175/61, 73, 76

[56] References Cited

U.S. PATENT DOCUMENTS 4,638,873 1/1987 Welborn ..... 175/76

4,770,258 9/1988 Falgout, Sr. ..... 175/73

4,938,297 7/1990 Schmidt ..... 175/73

5,220,963 6/1993 Patton ..... 175/61

*Primary Examiner*—William Neuder

*Attorney, Agent, or Firm*—C. W. Alworth

[57] ABSTRACT

A tool for controlling azimuth and/or inclination in a wellbore and methods for utilizing the same is disclosed. The tool generally comprises a freely rotating mandrel, for transmitting drilling forces, contained within two eccentric sleeves. The outer sleeve has an eccentric longitudinal bore that forms a pregnant or weighted side that seeks the low-side of the wellbore. Two gauge inserts or stabilizer shoes are provided on either side of the outer sleeve at ninety degrees to the pregnant housing. The inner sleeve has a further eccentric longitudinal bore that contains the freely rotating mandrel. The mandrel is attached to the drill string at one end and to the drilling bit at the other. The position of the inner sleeve may be controlled, at will from the surface, so that the eccentric is kept to one side of the outer housing, thus transmitting a fulcrum force to the bit and controlling the azimuth and/or inclination of the wellbore. The pregnant housing contains drive means and assorted logic for controlling the position with respect to the pregnant housing of the eccentric bore of the inner sleeve.

34 Claims, 7 Drawing Sheets

SURFACE CONTROLLED WELLBORE DIRECTIONAL STEERING TOOL

TECHNICAL FIELD

The present invention relates to oil and gas drilling and more specifically relates to an apparatus and method for selecting or controlling, from the surface of the earth, the direction in which a wellbore proceeds utilizing standard drilling techniques.

BACKGROUND ART

The formation through which a wellbore is drilled exerts a variable force on the drill string at all times. This variable force is essentially due to the clockwise rotary motion of the bit, the weight applied to the drill bit and the strata of the formation. Formation is a general term used to define the material—namely rock, sand, shale, clay, etc.—that the wellbore will pass through in order to open a pathway or conduit to a producing formation. This variable force will result in a variable change in the direction of the wellbore.

The formation is generally layered by the action of nature over millions of years and is not necessarily level. The formation will have dips, defined as a change in direction of the layers of the formation, which can extend either upward or downward. As the drill bit moves into a dip or from one type of formation to another, the force on the drill bit will change and cause the drill bit to wander up, down, right or left. This wandering is the natural result of the reaction of the formation to the clockwise torque and forward drilling force exerted by the drill bit on the formation. Mathematically the result can be viewed as a simple vector cross product between the torque force and the drilling force or weight on bit. The cross product results in a component force towards the right of the drilling force. The industrial term given to this effect is "bit-walk" and many methods to control or re-direct "bit-walk" have been tried in the industry.

Bit-walk is predictable, but the magnitude and, frequently, the direction of bit-walk are generally unpredictable. Looking at the vector cross product model, it can be seen that as the drilling force or weight on bit is varied, the cross product varies. Or, as the RPM of the drill string is varied, the cross product varies. Or, as the formation changes, the cross product changes. In drilling a wellbore, all of these forces constantly vary; thus, the magnitude of bit-walk constantly changes. The industry has learned to control the effects of bit-walk in a vertical hole by varying the torque and weight on bit while drilling a vertical hole. However, in an inclined (non-vertical) hole bit-walk causes a number of problems.

By industry definition, once an inclined hole is established, the side of the wellbore nearest to true vertical is called the "low-side" of the hole. The opposite side of the hole is referred to as "high-side" and is used as a reference point throughout the wellbore drilling operation. The drilling force follows the longitudinal extension of the wellbore; thus, the drilling force is parallel to and spaced from the low-side of the hole. Since bit-walk is the result of applied torque and drilling force, then it can be anticipated that normal bit-walk will be to the right of the low-side of the hole. This definition applies in all wellbores.

In a vertical hole or slightly inclined hole, bit-walk may be controlled by developing as much rigidity as possible in the lower portion of the drill string near to the drill bit. This can be and generally is accomplished by using drill string components of high rigidity and weight (drill collars or heavy-weight drill pipe) and stabilizers. A stabilizer, well known in the industry, is a tubular member with a combination of radial blades, often having a helical configuration, circumferentially arranged around the tubular and extending beyond the outer diameter of the tubular. The extension of the stabilizer blades is limited to the diameter of the drill bit. Thus, the stabilizer will work in a stable hole; however, if the wellbore washes out (increases in diameter due to formation or other downhole mechanical or hydraulic effects) or where the lateral force exerted by the blades is less than the torque effect of the drill bit, then the stabilizer loses its effectiveness and bit-walk will occur. In a highly inclined or horizontal well, bit-walk becomes a major problem.

Very often the driller wishes to deviate the wellbore or control its direction to a given point within a producing formation. This operation is known as directional drilling. For example, a water injection well in an oil field is generally positioned at the edges of the field and at a low point in that field (or formation). A vertical wellbore will be established and the wellbore "kicked-off" from vertical so that an inclined (or even horizontal) wellbore results. It is now necessary to selectively guide the drill bit and string to the required point in the relevant formation. In order to achieve this objective, control of the wellbore is required in both the vertical plane (i.e. up and down) and in the horizontal plane (i.e., left and right).

At present, in order to deviate a hole left or right, the driller can choose from a series of special downhole tools or techniques. The industry often employs downhole motors and bent subs. More recently the steerable motor has become popular, although it uses similar precepts employed by the downhole motor and bent sub. Both of these tools act in a similar manner and both require that the drill string not be rotated in order to influence and control the wellbore direction.

A bent sub, a short tubular that has a slight bend to one side, is attached to the drill string, followed by a survey instrument, of which an MWD tool (Measurement While Drilling which passes wellbore directional information to the surface) is one generic type, followed by a downhole motor attached to the drill bit. The drill string is lowered into the wellbore and rotated until the MWD tool indicates that the leading edge of the drill bit is facing in the desired direction. Weight is applied to the bit through the drill collars and, by pumping drilling fluid through the drill string, the downhole motor rotates the bit. As the bit cuts the wellbore in the required inclination and direction, the drill string is advanced. When drilling with a bent sub and motor, after the correct inclination and direction are established, the entire string is tripped to the surface, the bottom hole assembly (bent sub, downhole motor and drill bit) replaced with a single drill bit, the string is then tripped into the wellbore, and regular drilling operations restarted. This procedure will be repeated if the direction of the wellbore is unsatisfactory.

The advantage of a steerable motor is that the assembly does not require tripping immediately after the correct inclination and direction are established; the motor can be retained and will drill as a conventional "rotary assembly". Whenever the assembly is tripped, a new bottom hole assembly will be configured which will, theoretically, allow continuation of the wellbore along the correct plane and at the correct angle from vertical.

It follows that the deeper or longer the wellbore, more time will be used in making a return trip whenever tools have to be changed. For example, the bent sub may not have enough angle which will always require a round trip.

One of the earlier inventions giving sufficient control to deviate and start an inclined hole from or control bit-walk in a vertical wellbore may be in found U.S. Pat. No. 3,561,549 entitled Slant Drilling Tools for Oil Wells by Garrison and Tschirky. Garrison et al. disclose an improvement in which a non-rotating sleeve having a plurality of fins (or wedges) on one side is placed immediately below a downhole motor in turn attached to a bit. This device acts in a similar manner to an offset packer and biases the downhole assembly away from the fins (or wedges). The device must be orientated like an offset packer before commencing drilling operations. Once the wellbore is established in the desired direction, the device must be taken out of service by a round trip out of and back into the wellbore. The disclosure discusses a second orientation device above the downhole motor. This device is more properly applied when starting an initial inclination or when correcting a vertical hole which has drifted from true vertical.

U.S. Pat. No. 4,220,213 by Hamilton discloses a Method and Apparatus for Self Orientating a Drill String while Drilling a Wellbore. The device consists of an offset mandrel with a rotatable tubular extending through the mandrel and a shoe, laterally attached to the outside of the mandrel, which slides along the wellbore. The offset mandrel is heavily weighted (by supplying sufficient material when manufacturing the mandrel) at 90 degrees to the "shoe." This tool is attached to the drill string immediately above the drill bit and the remaining drill string contains the usual downhole tools for weight, flexibility, control of inclination, wellbore surveying, etc. The heavily weighted portion of the Hamilton mandrel seeks the low-side of the hole, thus orientating the shoe to one side of the wellbore. The sliding shoe places a bias on the attached drill bit in a similar manner as does an offset packer or the Garrison et al. device.

The tool is designed to take advantage of gravity because the heavy side of the mandrel will seek the low-side of the hole. The shoe is attached to the mandrel on the side and one-quarter along the circumference. The device is designed to counteract the vector cross product of torque and drilling force which normally causes the bit to walk to the right. This means that a counter force must be applied that biases the bit to the left; thus, the normal position of the shoe is on the right. In using the tool, the weighted bottom seeks the low-side of the wellbore, the shoe rubs along the right side of the wellbore and the tubular rotates freely within the mandrel supplying drilling torque to the bit. The extension of the shoe beyond the bit circumference would be set by the size of the wellbore.

This tool is known to work: however, it suffers the same drawback as does the offset packer and the tool of Garrison et al., namely if the bit-walk forces change, then the tool must be changed or removed necessitating a round trip.

U.S. Pat. No. 4,638,873 to Welbom discloses a Direction and Angle Maintenance Tool and Method for Adjusting and Maintaining the Angle of a Directionally Drilled Borehole. This tool is essentially an improvement to the Hamilton device and operates in much the same manner. Welborn uses a spring-loaded shoe and a weighted heavy side which can accommodate a gauge insert held in place by a retaining bolt. Welborn explains that the lowside gauge insert will cause hole deviation (inclination) and the spring-loaded shoe will resist the tendency for bit-walk. He claims an improvement to the bearings within the mandrel, which reduces the tendency of the bearings to fail. The disclosure states that the gauge insert is chosen to obtain a particular change in inclination and that the shoe may be used (or left off) to correct bit-walk to the right. If a change in bit-walk rate occurs or if the bit tends to move to the left, then this tool, like the other tools described, must be withdrawn. This necessitates a round trip.

Thus, the prior art can correct bit-walk in a wellbore. However, if changes in the forces that cause bit-walk occur while drilling, all the prior art tools must be withdrawn in order to correct the direction of the wellbore. The absolute requirement for tool withdrawal means that a round trip must be performed. This results in a compromise of safety and a large expenditure of time and money. The industry needs a true left/right downhole tool that can remain in place on the downhole assembly and have its effect switched from the surface. That is, a tool that will cause the wellbore to turn either to the right or to the left whenever required.

DISCLOSURE OF INVENTION

The invention is, effectively, a non-rotating stabilizer which consists of an eccentrically bored sleeve or mandrel with more material on one side so that the sleeve is weighted to the side opposite the eccentric bore. A second eccentric sleeve or mandrel is inserted through the bore of the first mandrel and supported by an appropriate bearing system so that the second eccentric sleeve may be moved through 180 degrees, when required, by an internal means. A third tubular, or rotating mandrel having no eccentricity, is inserted through the inner eccentric sleeve and supported by appropriate bearings so that it is completely free to rotate without restriction. The rotating mandrel is terminated at both ends in the appropriate standard tool joint used in the drilling industry for ready attachment to subs, the bit, other downhole tools, or drill pipe. This rotating mandrel transfers the rotary motion of the drill pipe to the drill bit and acts as continuation conduit of the drill pipe for all drilling fluids passing down the drill pipe and onto the drill bit. Two stabilizer shoes (blades or wedges) extend radially outward and laterally along the circumference on either side of the outer eccentric sleeve.

The inner eccentric sleeve holds the rotating mandrel to the left or right of the center line of the outer sleeve (or housing) and close to one of the two lateral stabilizer shoes. The exact position (left or right) of the inner sleeve is selected by an internal drive means, and the inner sleeve can only, in one embodiment, be positioned to the right or the left. In another embodiment, an internal means may be added which would include a "null" or "zero-bias" position as a further option. This multiple position stabilizer is technically more challenging, incorporates all of the components currently proposed, yet represents a level of complexity not available in current drilling scenarios.

The internal drive means can be battery powered, hydraulically powered, powered by rotation of the rotating mandrel, or powered by drilling fluid flow. It is designed to rotate the inner eccentric sleeve through 180 degrees, i.e. from its right-most position to its left-most position. Hydraulic, mechanical, or electric logic causes the internal drive means to change positions of the inner eccentric sleeve whenever signaled. The signalling may be accomplished by stopping the drill string rotation for a predetermined time period, by sending a series of drilling fluid pressure pulses, or by some other means.

If the internal motor is hydraulic, then the source of hydraulic power will normally be the flowing drilling fluid. The conversion of drill fluid pressure into hydraulic pressure is well known in the industry. Alternately, the rotation of the rotating mandrel can be used to provide hydraulic power to the hydraulic motor or a mechanical reversing gear means employing a slip-clutch may be employed. If the inner motor is electric, then power can be supplied by long lived storage batteries, similar to those used in MWD tools, housed within the tool.

The instant device applies selectable bias (right or left of low-side) to the drill bit. The weighted heavy side of the outer eccentric sleeve will, due to the effects of gravity, seek the low-side of the hole. The two lateral stabilizer shoes will inhibit rotation of the outer eccentric sleeve whenever the rotating mandrel, attached to the drill string, is rotated. The inner eccentric sleeve is positioned to the right or left of the center line of the wellbore depending on its initial position. Normally, because the device is used to prevent bit-walk, the inner eccentric sleeve will be initialized on the left-most side (viewed in the direction the wellbore takes) in order to produce right bias. With the bore of the inner eccentric sleeve on the left-most side of the outer sleeve, the rotating mandrel is offset towards the left of the hole producing a force exerted from the right side of the wellbore. (This is similar to the effect produced by the devices of both Garrison, Welborn, and by an offset packer.) The use of the tool is straightforward. A standard bottom hole assembly (BHA) is assembled containing the appropriate quantity of drill collars, proper MWD tool(s) or other instrument(s), the instant device (properly initialized) and a drill bit. The BHA is attached to the drill string and the string lowered into the wellbore.

It is assumed for this explanation that the device is set to prevent normal right-hand bit-walk. Standard drilling operations are commenced and directional information obtained from the MWD is monitored. If the wellbore starts to drift too far to the left then, depending on the logic employed within the tool, the rotation is stopped or the fluid pressure is pulsed in order to drive the inner eccentric sleeve to the opposite side. Standard drilling is then continued and the wellbore direction monitored. When the wellbore drifts too far back towards the right the necessary signalling means is employed to switch the position of the inner sleeve and the drilling operation resumed. The process is repeated as needed.

The net effect will be a wellbore that has a slightly undulating s-shape in the lateral plane: however, this will not be a problem because most directionally controlled wellbores have sharp s-curves that undulate from one side to another or even from low-side to high side and the degree of undulation can be great. Hence, this device solves the problem of a true, on demand, left/right downhole tool and achieves its objective of reducing the number of round trips in a drilling operation. The device will produce a better "quality" wellbore with fewer doglegs.

The tool may be employed as a pure downhole steering device. That is, if the driller wishes to turn left he selects "left-turn"; on the other hand, if the driller wants to turn right, he selects "right-turn". A signalling means which affects the drilling fluid surface backpressure can be employed to communicate to the driller the state of the device, and may be included within the device. In general, a change in direction to the left will be slower than a change in direction to the right because of the natural effects of bit-walk. In a similar manner and with proper additional tools, the device can be used for up/down control in inclined wellbores. The device will operate with both conventional drilling and downhole motors.

Embodiments of the invention will now be described by way of example only with reference to the accompanying drawings.

MODES FOR CARRYING OUT THE INVENTION

The device will first be discussed in general terms in order to explain the inventive concept of a dual eccentric sleeve arrangement. Next the inventors' preferred means for rotating or switching the inner mandrel from its left-most position to its right-most position (or vice-versa) will be described as will be an alternate. Additional means for obtaining the switching will be discussed as will be the back pressure drilling fluid signalling means for indicating the position of the inner sleeve. Finally, the technique for proper use of the device will be described.

Figure 1:
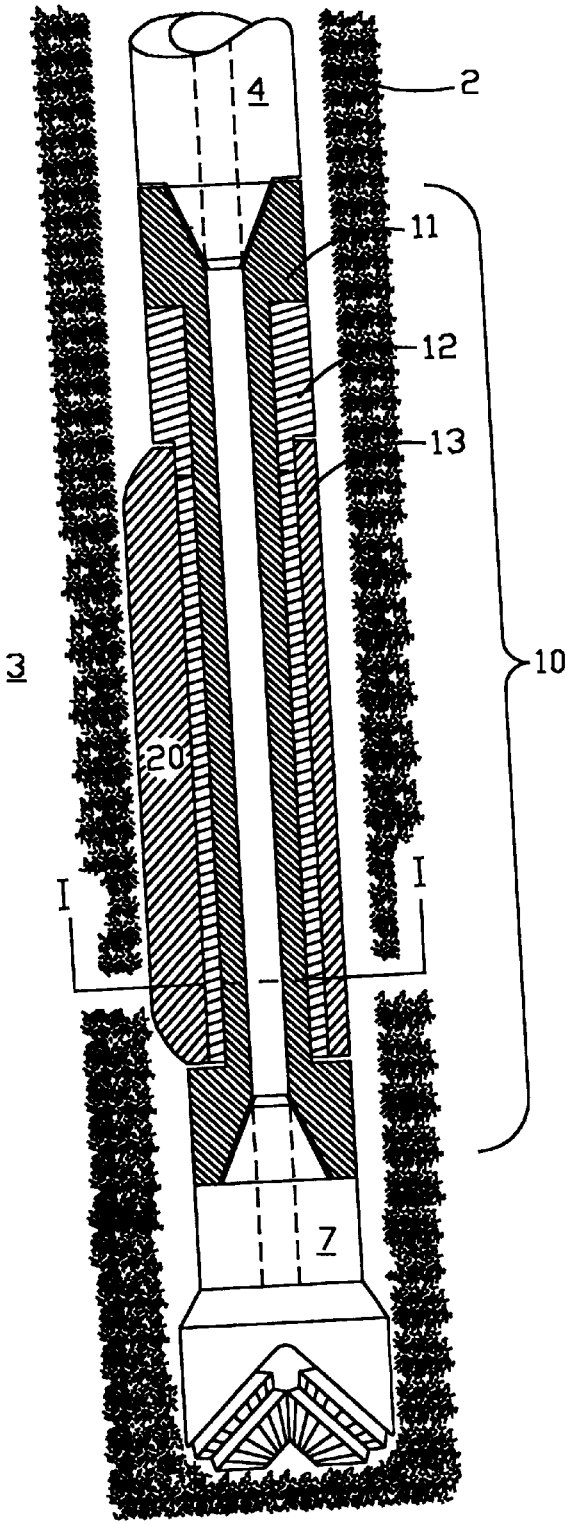
FIG. 1 shows an elementary cutaway side elevational view of a tool according to the invention in a slightly inclined wellbore having its low-side on the left.

The device will be described using elementary FIGS. 1 through 4. FIG. 1, a side elevational view, shows a cutaway of the device, 10, in a slightly inclined wellbore. This figure serves to amply define the low-side of the hole, which the industry defines as the side of the hole nearest the center of the earth. The low-side of the hole, 3, is on the left-hand side of the overall wellbore, 2. FIG. 1 shows the device in a slightly inclined hole for purposes of illustration only.

Starting at the top of FIG. 1, the device is shown attached to an adapter sub, 4, which would in turn be attached to the drill string (not shown). The adapter sub (not a part of the invention) is attached to the inner rotatable mandrel, 11, and may not be necessary if the drill string pipe threads match the device threads. This mandrel is free to rotate within the inner eccentric sleeve, 12. Not shown, nor discussed, are the bearing surfaces which will be required in the device between the inner rotating mandrel, 11, and the inner eccentric sleeve, 12. Design requirements for these bearings will be discussed because the mandrel, 11, must be capable of sustained rotation within the inner sleeve, 12. The inner eccentric sleeve, 12, may be turned freely within an arc, by a drive means (not shown), inside the outer eccentric housing or mandrel, 13. The bearing surfaces between the inner and outer mandrels are not critical as they are they must be capable of remaining clean in they must be capable of remaining clean in the drilling environment. Sealed bearing systems would be appropriate.

In FIG. 1, the inner rotating mandrel, 11, is shown as being attached directly to a drill bit, 7. This would be preferable; however, the threads may differ between the two elements and an adapter sub (not shown) may be required for matching purposes.

Figure 4:
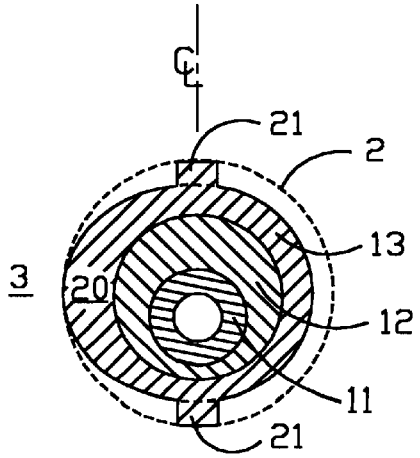
FIG. 4 is an elementary cross section of the tool of FIG. 1 taken at A—A in both FIG. 1 and FIG. 2. The dotted circle about the cross-section illustrates the expected position of the device within the wellbore.

FIG. 4 clearly shows the relative eccentricity of the inner, 12, and outer, 13, eccentric sleeves. In reality, the outer eccentric sleeve should be referred to as the "outer housing", for this element will contain the drive means (not shown in the referenced figures) for turning the inner eccentric sleeve, 12, within the outer housing, 13. (See FIG. 8 for details of the drive means.) The outer housing consists of a bore passing longitudinally through the outer sleeve which accepts the inner sleeve. The outer housing is eccentric on its outside, clearly shown as the "pregnant portion", 20.

The pregnant portion or weighted side, 20, of the outer housing forms the heavy side of the outer housing and is manufactured as a part of the outer sleeve. The pregnant housing contains the drive means for controllably turning the inner eccentric sleeve within the outer housing. Additionally, the pregnant housing may contain logic circuits, power supplies, hydraulic devices, and the like which are (or may be) associated with the 'on demand' turning of the inner sleeve.

There are two stabilizer shoes, 21, on either side of the outer housing located at right angles to the pregnant housing and on the center line drawn through the center of rotation of the inner sleeve. These two shoes serve to counter any reactionary rotation on the part of the outer housing caused by bearing friction between the rotating mandrel, 11, and the inner eccentric sleeve, 12. The stabilizer shoes are normally removable and are sized to meet the wellbore diameter. In fact, the same techniques used to size a standard stabilizer would be applied in choosing the size of the stabilizer shoes. Alternatively, the shoes, 21, could be formed integrally with the outer housing, 13. As will be explained, the pregnant or weighted portion of the outer housing, 13, will tend to seek the low side of the hole, and the operation of the apparatus depends on the pregnant housing being at the lowside of the hole.

Figure 3:
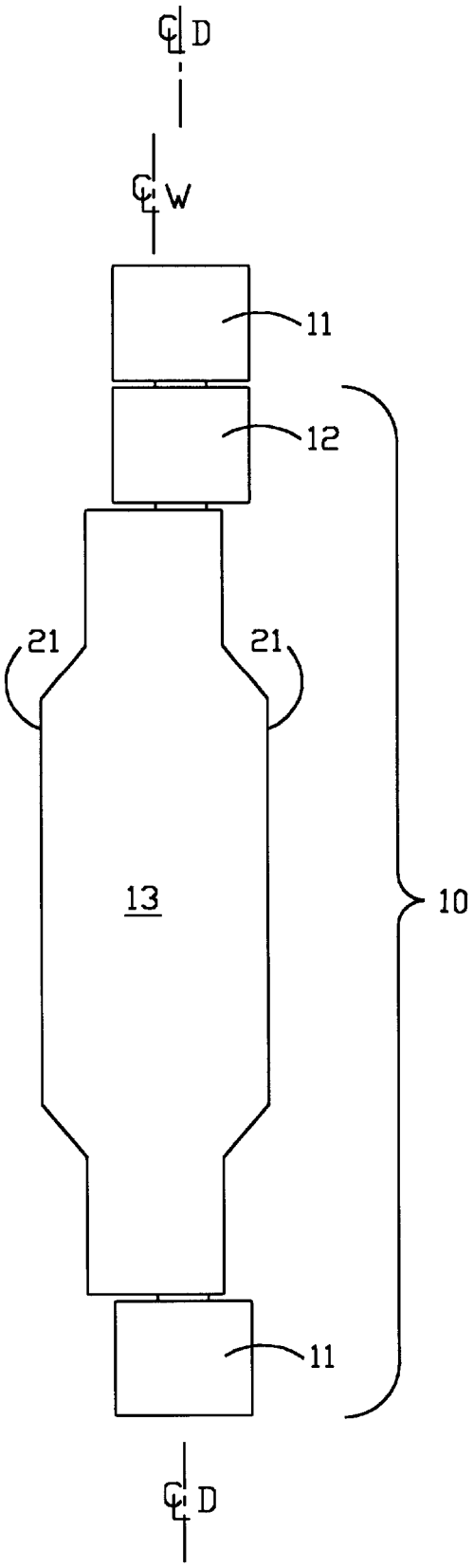
FIG. 3 is an elementary side elevational view of the tool of FIG. 1, rotated through ninety-degrees thus having the weighted side at the back of the drawing, showing stabilizer shoes and the eccentric offset given to the inner tubular or rating mandrel.
Figure 2:
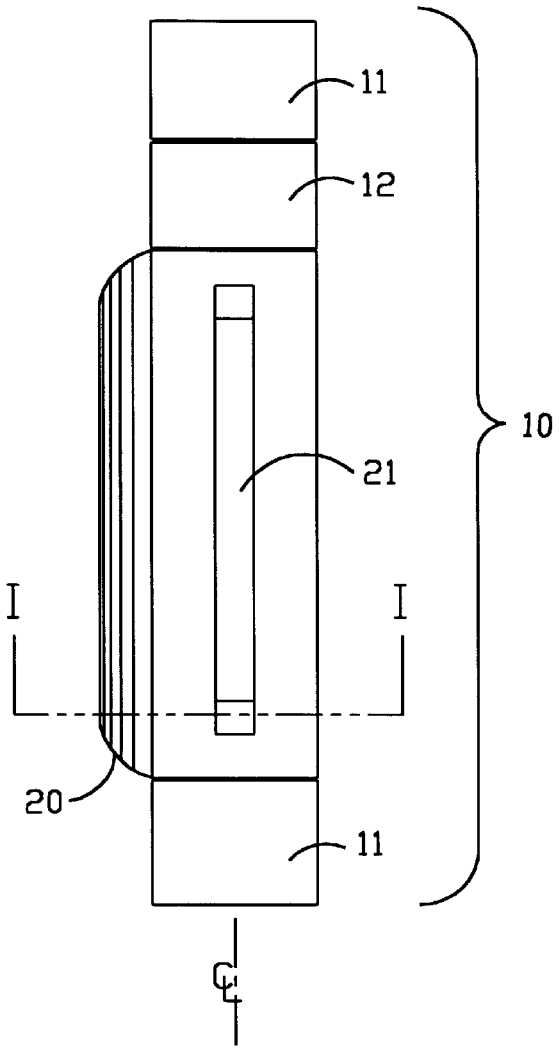
FIG. 2 is an elementary side elevational view of the tool of FIG. 1, showing the weighted side on the left and illustrating the position of the sliding shoes.

FIGS. 2, 3 and 4 show the centre-line of the wellbore as $C/L_w$ and the centre-line of the bit (or drill string) as $C/L_D$. Note that these longitudinal centre-lines are offset by the eccentricity of the inner sleeve in FIG. 3 and are co-located in the views of FIGS. 2 and 4. (In fact, these centre-lines are colocated in the view of FIG. 1.) Simply stated, when the tool is viewed through the axis which passes through the pregnant housing, the longitudinal axes are offset; on the other hand, when viewed through the axis which passes through the two stabilizer shoes, 21, the two longitudinal centre-axes are co-located.

The bearings between the inner rotatable mandrel and the inner eccentric sleeve pose a number of interesting problems. If the tool is used in conventional drilling, the inner mandrel must be capable of turning at speeds of up to 250 RPM within the inner eccentric sleeve. If the tool is used with downhole motors, the bearing speed will depend on the position of the downhole motor with respect to the tool. The downhole motor may be placed at either end of the tool. If the motor is placed next to the bit, then the rotational bearing speed will be zero. If the tool is placed between the downhole motor and the bit the rotational speed will be the same as that of the output shaft of the downhole motor. This speed can be higher than 250 RPM, which is normally regarded as the maximum RPM encountered in conventional rotary drilling.

The inner mandrel to inner sleeve high speed bearings must be lubricated, and the lubricating fluid will be the drilling fluid that circulates throughout the system. This means that the bearing must be capable of operating with some solids, having a potentially abrasive nature, present in the stream. Bearings of this nature are well understood in the industry and will cause little problem. The thrust bearing, between the two elements, see location 28 on FIG. 9, must be expected to show wear and is designed so that it can be replaced at reasonable service intervals. Basically the thrust bearing surface is a sacrificial bearing and plans should be made to replace this bearing with each change of bit. (At least the bearing should be examined each time the tool comes to the surface.)

Figure 8:
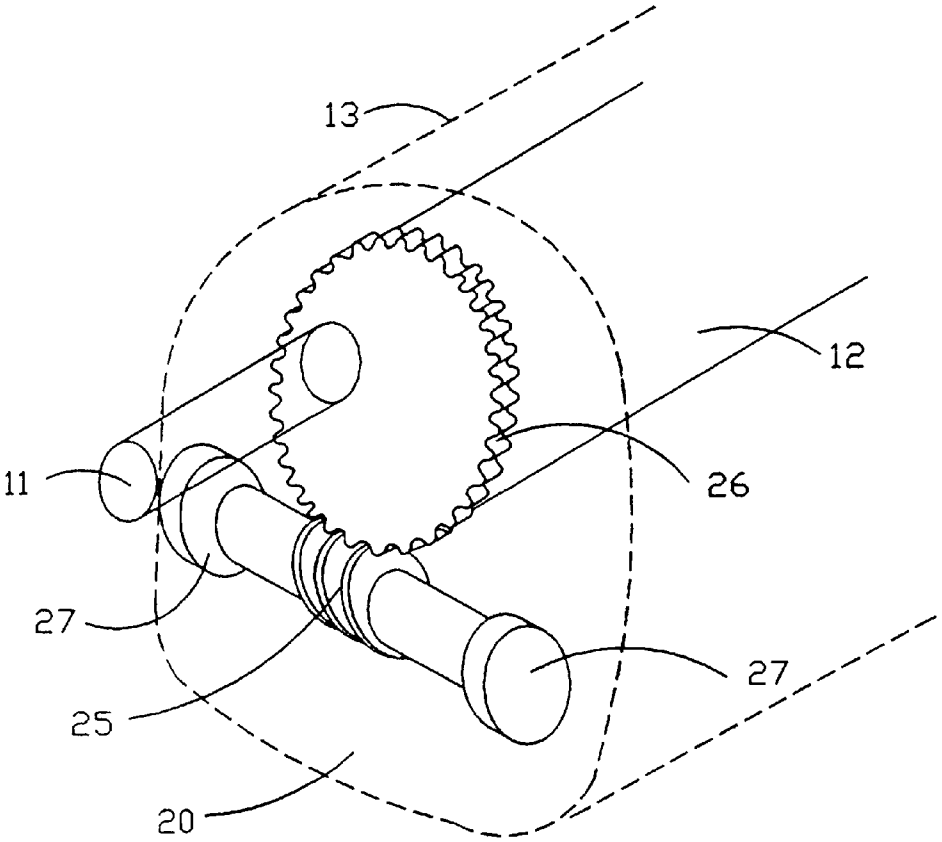
FIG. 8 illustrates a worm drive coupled to the inner mandrel powered by a motor means.

The rotation between the outer housing, 13, and the inner eccentric sleeve, 12, is controlled from the surface and is an 'on demand' occurrence. Thus, these bearing surfaces need not take high continuous rotation speeds and standard sealed bearings may be used. FIG. 8 illustrates how the inner sleeve operates. A worm drive, 25, drives the driven gear, 26, attached to inner mandrel, ordinarily, through 180-degrees. The worm gear is driven by a motor, 27. A worm drive is used because of its natural mechanical advantage. That is, the driven gear, 26, will have great difficultly turning the worm gear, 25. Thus, this gear arrangement will provide a natural lock for the inner sleeve. It is possible to directly drive the inner sleeve by a similar device used to drive the worm gear shaft. The illustration of the drive arrangement in FIG. 8 is to show the principle involved and is not intended to serve as a limitation on the device.

The motor means may take a number of forms. In the preferred arrangement, the motor means is a DC motor driven by a lithium battery bank similar to those used in MWD tools. The motor and the batteries are placed in a sealed compartment within the pregnant housing of the outer housing. The logic used to start and stop the drive motor is also housed in the pregnant housing.

In an alternative embodiment employing an hydraulic motor, the worm gear drive would be employed. Standard industrial hydraulic techniques would be used. The hydraulic power source would be taken from the drilling fluid in a similar manner as in a downhole motor. The source would be activated by electro-mechanic-hydraulic logic which would only require power when the eccentric is to be driven from one position to the other. Another alternative would be to use an electric drive means but incorporate a downhole generator (in the housing) which would take its power from the drilling fluid whenever the logic requires a change in position.

Figure 5A:
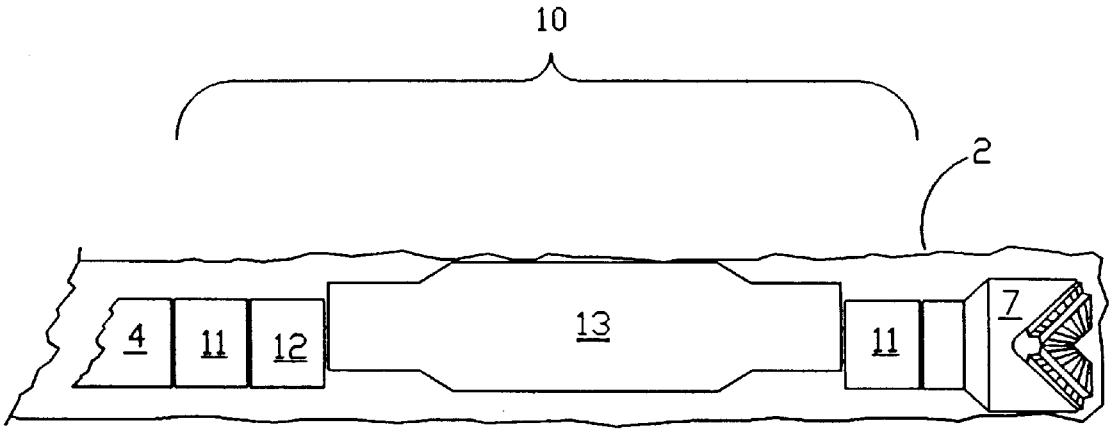
FIG. 5A is an elementary top view of the tool of FIG. 1 employed in a wellbore illustrating its use in making a right-turn.
Figure 5B:
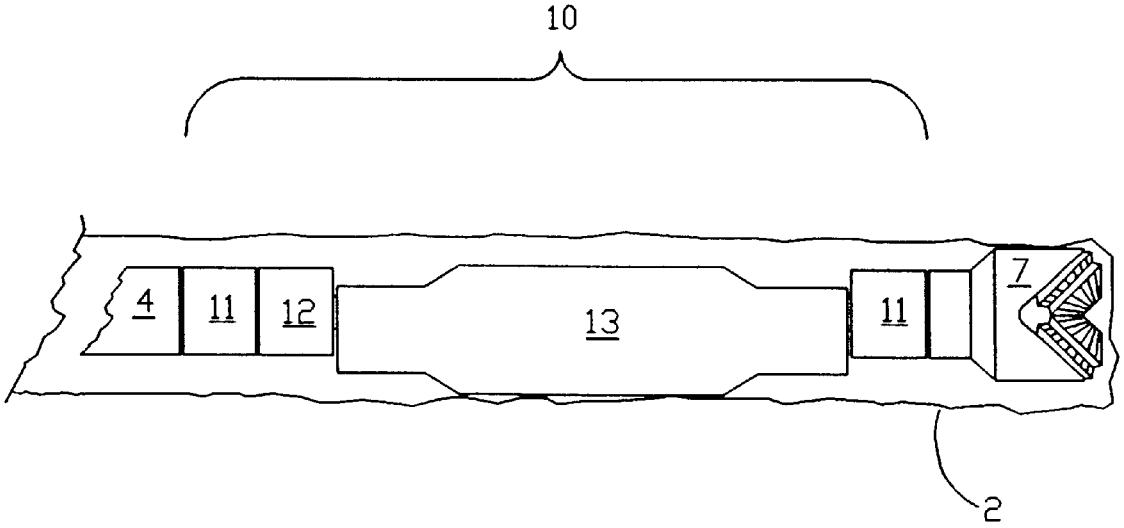
FIG. 5B is an elementary top view of the tool of FIG. 1 employed in a wellbore illustrating its use in correcting right-hand bit-walk or, alternatively, illustrating its use in making a left-hand turn.

FIG. 4 shows the instant device with its inner eccentric sleeve on the centre-line between the two stabilizer shoes, 21, and to the right side of the overall device. FIG. 5A shows a "top-view" of the device wherein the inner eccentric sleeve is set to the far right in line with the centre-line of the two stabilizer shoes. By "top-view" it should be understood that FIGS. 5A and 5B are viewed from high-side of the wellbore. Thus, the state of the inner eccentric shown in FIG. 4 and in FIG. 5A will cause the outer housing, 13, to exert pressure against the left-hand side of the wellbore, when viewed from high-side. The fulcrum effect against the side of the left side of the wellbore will cause the bit to create a hole with right-hand bias.

As previously stated, the rotation of the inner eccentric sleeve, 12, is ordinarily limited to 180-degrees; thus, when the device receives the proper signal from the surface, the drive means will rotate the inner eccentric from its right-most position, through 180-degrees, to its left-most position. This state is shown in FIG. 5B. When the inner eccentric is in this state, it will cause the outer housing, 13, to exert pressure against the right-hand side of the wellbore, when viewed from high-side. The fulcrum effect against the side of the right side of the wellbore will cause the bit to turn to the left. The "quality" of the wellbore produced by the instant device will be much improved over the present state of the art as will be explained later.

The concept explained in the previous two paragraphs is the fundamental invention where the inventors have recognized that a simple pregnant housing, which will always seek the low side of the wellbore, can be used to selectively switch an inner eccentric to exert a fulcrum force against the one or the other side of a wellbore. The invention, out of choice, places a 180-degree limit on the motion of the inner eccentric. This limit is brought about because of engineering logic and mechanical considerations. That is, it is easier to signal the tool to switch sides and allow the inner drive means to rotate the inner sleeve from one 'stop' to another 'stop' rather than complicate the logic and the internal drive means. Modem technology would allow the use of 'stepper' type drive means wherein the inner eccentric could be positioned at any desired state with respect to the outer housing. Thus, the preferred embodiment which places a 180-degree arc on the inner sleeve must not be construed as a true limitation on alternative embodiments of the device.

If a true stepper motor means is placed within the housing, with no stop limits, then it would be possible to use the same apparatus to control up/down/left/right drill bit direction. The physical principal explained in the previous paragraphs relating to left or right directional control would still apply. For example, the inner sleeve could be positioned so that the offset was at the top of the housing. This would place the fulcrum on the bottom of the outer housing or directly on the actual pregnant housing and the bit would move upward. In a similar manner the bit could be driven downward. Any combination of up/down/left/right bit directional control could be accomplished.

The pregnant housing portion, 20, of the outer sleeve provides the reference point or "earthing point" against which the bit bias is referenced. The actual bias forces are applied to the appropriate sides of the wellbore through one of the stabilizer shoes, 21. It is important that, during rotation of the rotatable mandrel, 11, the rotational torque transferred to the outer sleeve, 13, does not exceed the mass of the outer sleeve. If the transferred torque exceeds the outer housing mass, de-stabilization of the outer housing will result—namely, the outer housing will turn. If the outer housing turns away from being the reference for the low-side of the hole, then bit bias will not be correct and the directional qualities of the device will fail.

Thus, when employing this apparatus, it may be necessary to use different speeds for rotation of the inner sleeve in order to overcome the mass-torque limitations of the outer housing. Paradoxically, the mass of the housing becomes more effective as the angle of inclination (wellbore deviation from vertical) increases; thus, higher rotational speeds may be used. Fortunately, this is coincidental with the requirement for rapid tool response in a high angle (near or horizontal) wellbore. The operator will have to monitor the downhole performance of the tool to determine if the tool is turning away from the low-side reference point. Standard well survey devices can provide this information. Adjustments in rotational speed of the inner sleeve can be varied at the surface to compensate for any shortfall in the mass-torque capacity of the outer housing.

Figure 6:
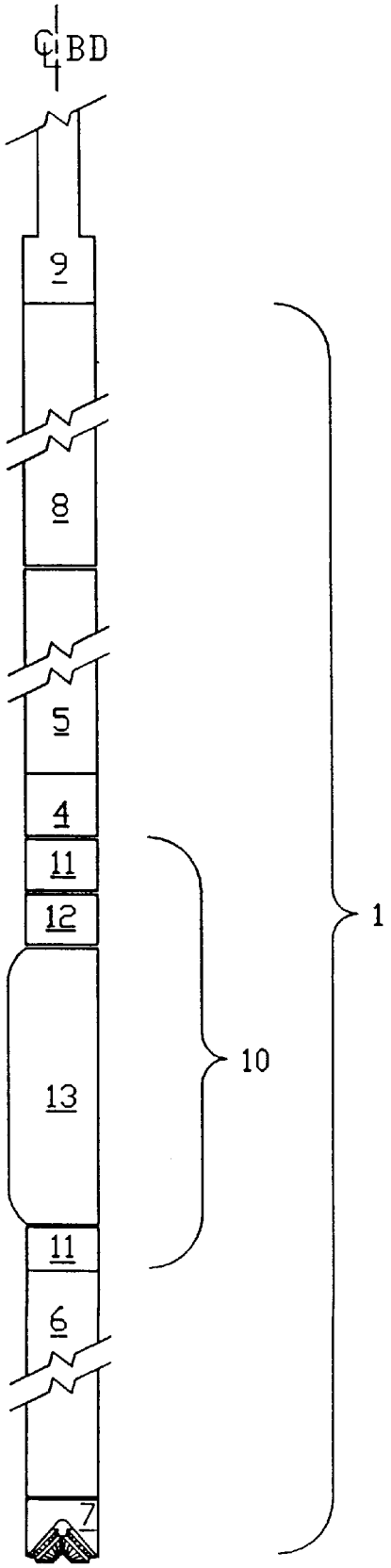
FIG. 6 is a suggested Bottom Hole Assembly, including a tool according to the invention, bit, MWD tool, drill collars, etc. used for left/right borehole correction only.

In drilling operations, as previously explained, there is generally a variable force attempting to drive a bit away from the desired trajectory. Thus, the tool should first be considered to control bit-walk or left/right direction. FIG. 6 illustrates a potential bottom hole assembly (BHA) for controlling bit-walk or obtaining left/right directional control. The BHA consists if a bit, 7, an optional adapter sub, 6, the device itself, 10, another optional adapter sub, 4, the required surveying tools, 5, and any required drill collars, 8. This assembly would be attached to the drill string, 9. Additional stabilizers (not shown in FIG. 6) would be added as per standard drilling procedures.

Figure 7A:
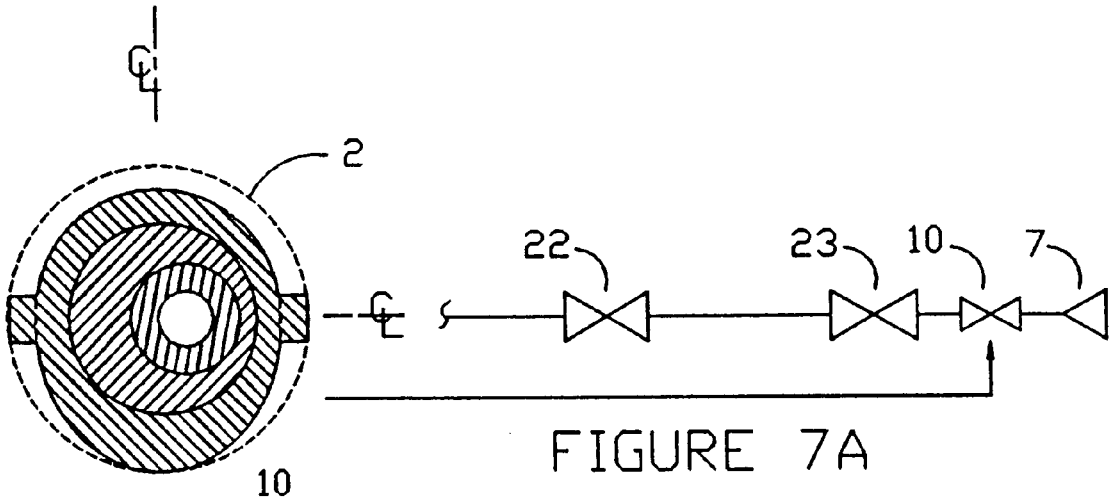
FIG. 7A is the diagrammatic illustration for the suggested Bottom Hole Assembly of FIG. 6 showing the device, bit and stabilizers used for left/right borehole correction only.

FIG. 7A is a diagrammatic illustration of an arrangement of stabilizers used in a drilling operation without showing required collars, survey tools and subs. The instant device, 10, is followed by a second string stabilizer, 23, and any additional stabilizers, 22, that the drilling program may require.

Figure 7B:
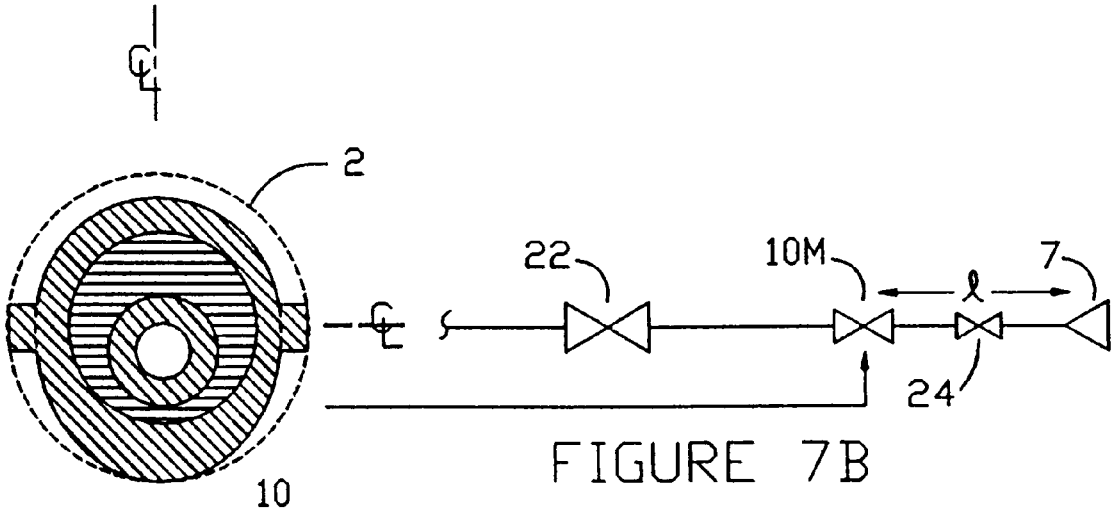
FIG. 7B is a suggested diagrammatic Bottom Hole Assembly, including the device, bit and stabilizers used for up/down borehole correction only.

As previously explained, the tool can be modified to provide up/down directional control and the easiest way to accomplish this would be to make one end of the inner sleeve arc offset position lie at the bottom of the tool or next to the pregnant housing. The other offset position would be 180-degrees away on top of the tool or opposite the pregnant housing. As previously explained, these two offset positions would fulcrum the bit up or down. FIG. 7B is a diagrammatic representation of the instant, although modified, device used to control up/down only. Here the bit, 7, is followed by a near bit stabilizer, 24, with the modified instant device, 10M, placed at distance "l" from the bit. This distance would range between 15 feet [4.57 m] and 30 feet [9.14 m]. (NB. the use of the British System of units is the standard of the drilling industry; hence, this description uses the industry standard.)

Figure 7C:
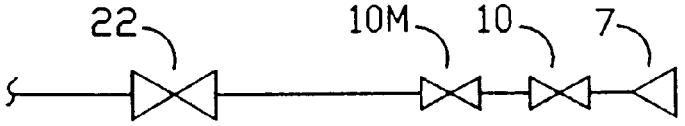
FIG. 7C is a suggested diagrammatic Bottom Hole Assembly used for up/down and left/right correction.

In a similar manner, the modified instant device, 10M, and the instant device, 10, could be used together in the same BHA to control left/right and up/down. FIG. 7C is a diagrammatic illustration of such a BHA without showing required survey tools, drill collars and the like.

Figure 10:
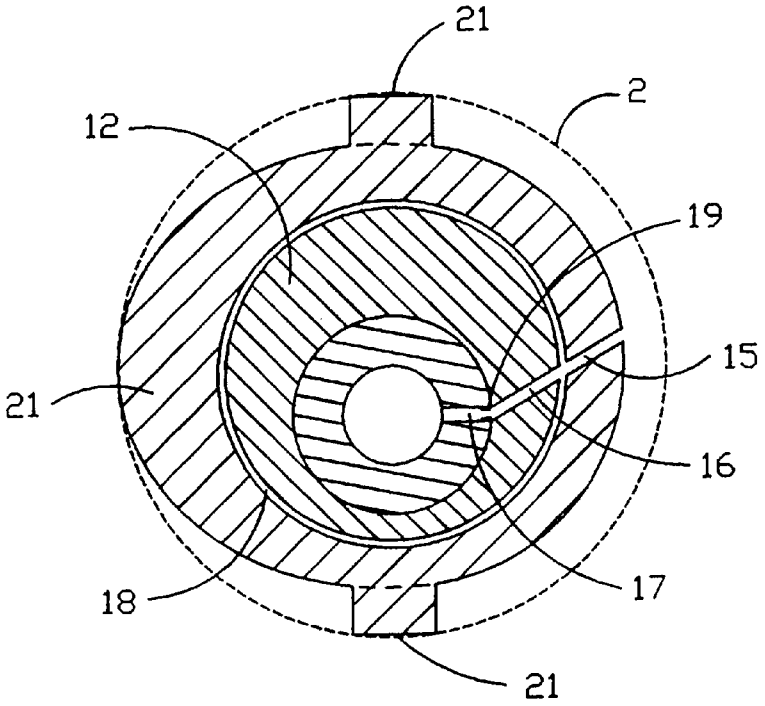
FIG. 10 is an elementary cross section of the device, showing the signalling means, taken at A—A in FIG. 8.
Figure 9:
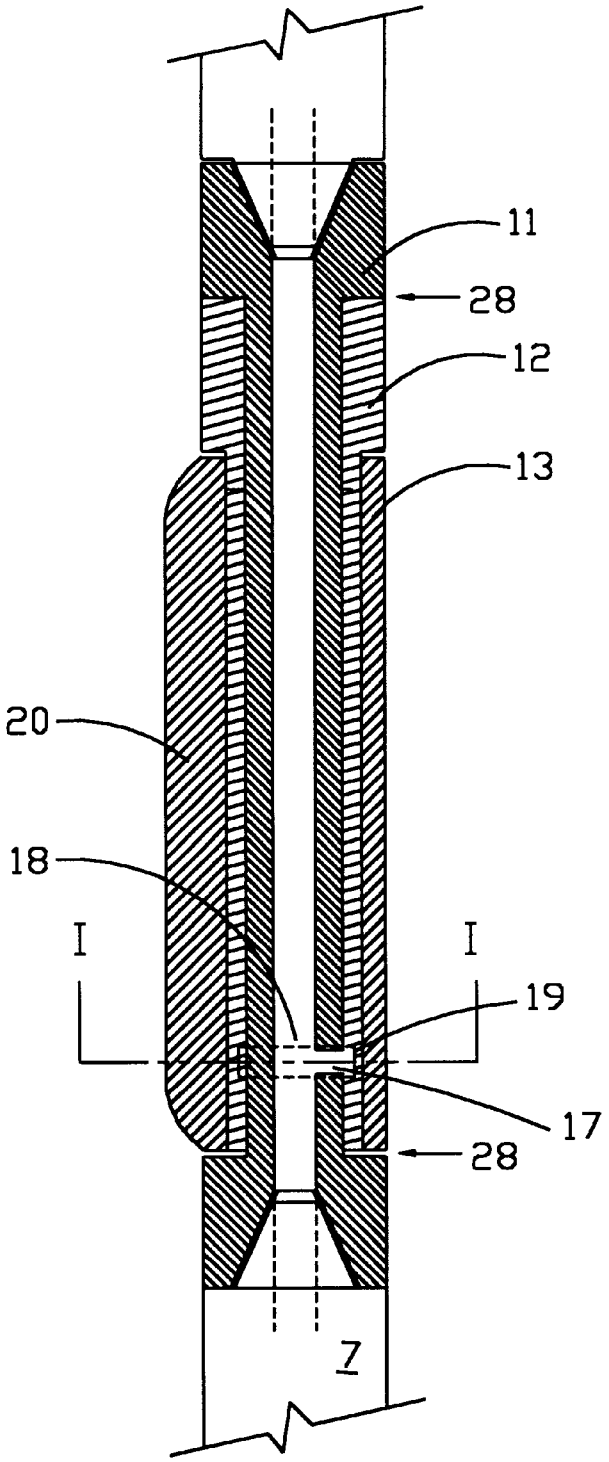
FIG. 9 is an elementary cross section illustrating the fluid pressure inner eccentric sleeve position signalling means.

A technique to signal the surface as to the position of the inner eccentric is required. It would be possible to use survey tools and track the wellbore direction and, whenever the direction is not correct, the tool may be signalled to "toggle states". That is to rotate from left to right or vice versa. (In the case of the modified tool, from up to down or vice versa) The preferred technique will be described for the original left/right (unmodified device) and is illustrated in FIGS. 9 and 10. A passageway, 17, is bored in the rotating mandrel which allows some drilling fluid to exit the bore via additional offset passages bored in the inner sleeve, 16, and in the outer housing, 15. The passageway, 17, in the rotatable mandrel terminates in bit-jet/orifice, 19, combination. The bit-jet is capable of taking the pressure drop without damage. A groove, 18, is cut in the outer surface of the inner eccentric sleeve which allows the drilling fluid to exit the bore even if the passages, 15,16, are not aligned. When the passages, 15,16, are aligned, the rate of drilling fluid leaving the bore is higher than the rate when the passages are not aligned. Thus, a pressure difference signal would occur at the surface whenever the inner sleeve is toggled or switched from one position to another.

In the right-most position, which is not the normal state for correcting bit-walk, more fluid leaves the bore (see FIG. 4). In the left-most position, which is the normal state for correcting bit-walk to the right, less fluid leaves the bore. Because more or less fluid is bypassing the bit, a pressure change will occur at the surface. Pressure changes are easily measured in the industry. If the pressure changes from high to low, then the eccentric is in the right-most position. If the pressure changes from low to high, then the eccentric is in the left-most position. A similar technique may be used for the up/down embodiment of the instant device.

Other techniques could be used to signal the state of the inner sleeve and such techniques are not outside the scope of this disclosure. For example, an encoding system similar to that used by MWD tools could be employed. A series of coded pulses would be sent to the surface during motion of the inner sleeve which may be decoded, using standard industry techniques, to disclose the resting position of the sleeve. It may be possible to pass an electrical signal to an MWD tool and have that tool pass the required information to the surface. The passing of coded information to the surface as a series of mud pulses is well accepted and used in the industry.

In a similar manner, the passing of pressure pulses from the surface to the tool may be used to signal the logic to toggle the state of the inner sleeve. For example, the simplest and preferred toggling technique is to stop drilling for a period of time which exceeds the time period to add a joint of drill pipe. During this period of time, the mud pressure would drop and the logic "sees" the event. The logic starts a timer and after the proper period of time the inner sleeve is told to toggle its state. Depending on the motor means the sleeve would toggle or wait until fluid flow resumed in order to capture a driving force. This technique may be expanded to signal a stepper motor drive means to move to a given position, or to individually signal a BHA using both up/down and left/right tools. Thus, any of the standard mud signalling techniques fall well within the scope of this disclosure. The logic used in connection with the tool of the invention can be an integral part of the tool or located completely separate therefrom. Furthermore, an energy source or power pack for supplying the logic circuits can be located within the tool, as an attachment located in a separate sub, or completely remote therefrom.

The tool is simple to use and will be described in its present left/right embodiment. A suggested BHA is shown in FIG. 6 and has already been described. The tool would be assembled at the surface and set to its normal state (inner eccentric sleeve to the left of wellbore longitudinal centre axis). Normal drilling techniques are followed and the progress of the wellbore tracked using standard survey techniques. The apparatus has been initialized to exert a force to the left of wellbore centre-line; therefore, right bit-walk should not occur. The wellbore, will most likely slowly drift to the left. When the hole has moved too far to the left, then the apparatus is given its toggle (switch sides) signal. The surface mud pulses are monitored to check that the toggle has actually occurred and to confirm the state of the inner sleeve. Drilling operations would continue until the hole has gone too far to the right. In a similar manner, the apparatus may be used to directionally drill an inclined well. In the modified apparatus, similar procedures would be used for up/down control.

The prior art of deviation correction required a turn in the direction of the wellbore in order to correct for drift left/right (azimuth) or up/down (inclination) from the required wellbore path. Essentially, a bent sub and downhole motor (or steerable motor) would be placed in the wellbore and orientated in the required direction to correct for the calculated directional drift. These tools would place a dogleg (a relatively sharp turn in the wellbore when compared to the overall wellbore) at the point of correction. Once the wellbore was established in the correct direction, standard drilling techniques resume until the next survey shows unacceptable drift. Thus, a wellbore is not straight or smooth—it looks like a corkscrew. The instant device will allow for relatively smooth correction; thus, the wellbore will not look like a corkscrew and will be easier to enter and exit during all drilling, casing and production operations. That is, the "quality" of the wellbore will be significantly improved over the present state of the art.

Finally, it should be noted that the inner eccentric sleeve can be manufactured with varying degrees of eccentricity or offset from the wellbore centre-axis. The required eccentricity would depend on the formation, the diameter of the wellbore, speed of drilling, type of drilling, and the like. The vector interaction of the shoe with the wellbore wall is selectively controlled by the rotation of the inner sleeve; thus, the magnitude of the offset force is dictated by the ratio of the inner sleeve's eccentricity. A smaller ratio being equal to a smaller vector force and a larger ratio being equal to a larger vector force. The offset can vary from tenths of an inch [millimeters] up to inches [centimeters]. The larger the offset, the sharper the change in wellbore direction and the higher the load on the internal bearings. In drilling a straight wellbore the eccentricity offset should be less than about ½-inch [1.27 cm].

It should also be remembered that the inner eccentric offset and the effective gauge of the tool (effective gauge being defined as the tool diameter between the outer surfaces of the shoes) are interrelated. Thus, it is important that the effective gauge of the tool be readily adjustable in the field to fit the wellbore gauge (same as the tool's effective gauge) or to account for some unexpected interaction with the tool. For example, the formation may drive the tool further to the right than expected; thus, the right shoe could be increased in thickness while the left shoe could be decreased in thickness. The overall effective gauge of the tool would remain the same, but the side wellbore force on the right of the wellbore would be effectively increased. The actual values and the like would have to be field determined, as are many parameters in the drilling industry. Thus, the shoes are field replaceable and are held in place by pins or any similar effective retaining mechanism.

The choice of inner sleeve and consequential offset, and the tool's effective gauge, may be made at the rig site. The drilling engineers would look at formation characteristics, the drilling program and other well known parameters to determine an initial offset and gauge. If the tool was over- or under-correcting, then the inner sleeve (or shoes) would be changed at a suitable opportunity (such as a "bit trip") and the tool returned to the wellbore.

There has been disclosed heretofore in the above discussion the best embodiment and the best mode(s) of the present invention as presently contemplated. It should be understood that the examples given and the dimensions may be changed, that different signalling means may be employed, that different inner sleeve toggling means or drive means may be employed, and that other modifications may be made thereto without departing from the spirit of the present invention.

Appendix Invention Drawing Number Index

1 The Overall Bottom Hole Assembly (BHA)

2 Generally the Wellbore (Vertical, Inclined or Horizontal)

3 The Low-side of the Hole

4 Adapter Sub

5 Survey Tool (MWD or the like)

6 Adapter Sub (or Additional Down Hole Tools)

7 Drill Bit

8 Drill Collar(s)

9 Drill String

10 Generally The Instant Device

11 The Inner Rotatable Mandrel

12 Generally The Inner Eccentric Sleeve

13 Generally The Outer Eccentric Sleeve

14 Generally The Selector Drive Mechanism

15 Third Drilling Fluid Passageway in Outer Sleeve

16 Second Drilling Fluid Passageway in Inner Rotatable Mandrel

17 First Drilling Fluid Passageway

18 Drilling Fluid Groove in Inner Sleeve

19 Bit-jet and Orifice Plate

20 The "Pregnant" or Weighted Housing Part of the Outer Eccentric Sleeve

21 Stabilizer Shoes

22 Stabilizer

23 Second String Stabilizer

24 Near Bit Stabilizer

25 Worn Gear

26 Driven Gear

27 Drive Means

28 Thrust Bearing Position

What is claimed is:

1. An apparatus for selectively controlling from the surface of the earth a drilling direction of an inclined wellbore having a low side comprising:

a hollow rotatable mandrel having a concentric longitudinal bore;

a single inner eccentric sleeve rotatably coupled about said mandrel, said single inner eccentric sleeve having an eccentric longitudinal bore of sufficient diameter to allow free relative motion between said mandrel and said single inner eccentric sleeve;

an outer housing rotatably coupled around said single inner eccentric sleeve, said outer housing having an eccentric longitudinal bore forming a weighted side adapted to automatically seek the low side of the wellbore and having sufficient diameter to allow free relative motion between said single inner eccentric sleeve, said outer housing having an outer surface;

a plurality of stabilizer shoes longitudinally positioned along said outer surface of said outer housing; and, drive means for selectively rotating said single inner eccentric sleeve with respect to said outer housing.

2. The apparatus of claim 1 wherein said plurality of stabilizer shoes are each circumferentially offset a predetermined amount in relation to said weighted side of said outer housing.

3. The apparatus of claim 2 wherein two stabilizer shoes are provided.

4. The apparatus of claim 3 wherein said predetermined offset is ninety degrees to each side of said weighted housing.

5. The apparatus of claim 1 further comprising logic means for determining when said single inner eccentric sleeve should be rotated.

6. The apparatus of claim 5 wherein said logic means comprises means for sensing drilling parameters and decoding such parameters to determine when said single inner eccentric sleeve should be rotated with respect to said outer housing.

7. The apparatus of claim 6 wherein said apparatus is connected to a drill string wherein said drilling parameters include drill pipe rotation and said logic means includes means for detecting drill pipe rotation wherein said drill pipe rotation determines when said single inner eccentric sleeve should be rotated with respect to said outer housing.

8. The apparatus of claim 6 wherein said apparatus is connected to a drill string wherein said drilling parameters include drill pipe rotation and said logic means includes means for detecting drill pipe rotation and determining a time period between rotation and non-rotation of the drill string wherein said time period determines when said single inner eccentric sleeve should be rotated with respect to said outer housing.

9. The apparatus of claim 5 wherein said logic means comprises means for sensing wellbore fluid flow pressure pulses and decoding same pulses to determine when said single inner eccentric sleeve should be rotated with respect to said outer housing.

10. The apparatus of claim 5 wherein said logic means further comprises means for decoding and commanding said drive means to rotate said single inner eccentric sleeve to a given axial position within said outer housing.

11. The apparatus of claim 10 wherein said drive means for selectively rotating said single inner eccentric sleeve further comprises hydraulic motor means for axially positioning said single inner eccentric sleeve within said outer housing in response to said logic means.

12. The apparatus of claim 10 wherein said drive means for selectively rotating said single inner eccentric sleeve further comprises electric motor means for axially positioning said single inner eccentric sleeve within said outer housing in response to said logic means.

13. The apparatus of claim 12 wherein said apparatus is connected to a drill string wherein said drilling parameters include drill pipe rotation and said logic means includes means for detecting drill pipe rotation wherein said drill pipe rotation determines said axial position.

14. The apparatus of claim 12 wherein said apparatus is connected to a drill string wherein said drilling parameters include drill pipe rotation and said logic means includes means for detecting drill pipe rotation and determining a time period between rotation and non-rotation of the drill string wherein said time period determines said axial position.

15. The apparatus of claim 7 wherein said drive means and said logic means are stored within said outer housing.

16. The apparatus of claim 7 wherein said logic means is located within a separate housing connected to the combination of said mandrel, said single inner eccentric sleeve, and said outer housing.

17. The apparatus of claim 7 further comprising an energy source for supplying power to said logic means.

18. The apparatus of claim 17 wherein said energy source is located within a separate tubular connected to the combination of said mandrel, said single inner eccentric sleeve, and said outer housing.

19. The apparatus of claim 1 wherein said concentric longitudinal bore is capable of passing wellbore fluids.

20. The apparatus of claim 1 further comprising an energy source for supplying power to said drive means.

21. The apparatus of claim 20 wherein said energy source is located within a separate tubular connected to the combination of said mandrel, said single inner eccentric sleeve, and said outer housing.

22. The apparatus of claim 1 further comprising signaling means for signaling the relative position of said single inner eccentric sleeve with respect to said outer sleeve.

23. The apparatus of claim 22 wherein said mandrel has an interior, said outer housing has an exterior, and said single inner eccentric sleeve has a first axial position and a second axial position with respect to said outer housing, and wherein said signaling means comprises a series of drilling fluid passageways extending generally radially through said mandrel, said single inner eccentric sleeve and said outer housing such that, when said single inner eccentric sleeve is in said first position, said series of drilling fluid passageways align with each other so as to allow drilling fluid to flow readily from said interior of the said mandrel to said exterior of said outer housing accompanied by a relatively low pressure drop, and when said single inner eccentric sleeve is in said second position, said drilling fluid passageways are in misalignment so as to restrict drilling fluid flow from said interior of said mandrel to said exterior of said outer housing accompanied by relatively high pressure drop.

24. The apparatus of claim 23 where a bit-jet and orifice combination is positioned within said generally radial passageway in said mandrel adjacent said single inner eccentric sleeve.

25. The apparatus of claim 19, further comprising means for detecting a change in drilling fluid pressure.

26. An apparatus for selectively controlling from the surface of the earth a drilling direction of an inclined wellbore having a low side comprising:

a hollow rotatable mandrel having a concentric longitudinal bore, said concentric longitudinal bore capable of passing wellbore fluids and having an exterior side;

a single inner eccentric sleeve rotatably coupled about said mandrel, said single inner eccentric sleeve having an eccentric longitudinal bore of sufficient diameter to allow free relative motion between said mandrel and said single inner eccentric sleeve, said single inner eccentric sleeve having an exterior side;

an outer housing rotatably coupled around said single inner eccentric sleeve, said outer housing having an eccentric longitudinal bore forming a weighted side adapted to automatically seek the low side of the wellbore and having sufficient diameter to allow free relative motion between said single inner eccentric sleeve, said outer housing having an outer surface;

a pair of stabilizer shoes longitudinally attached to said outer surface of said outer housing circumferentially at ninety degrees to each side of said weighted side of said outer housing;

drive means for selectively rotating said single inner eccentric sleeve with respect to said outer housing, and logic means for determining when said single inner eccentric sleeve should be rotated.

27. An apparatus for selectively controlling from the surface of the earth a drilling direction of an inclined wellbore having a low side comprising:

a hollow rotatable mandrel having a concentric longitudinal bore, said concentric longitudinal bore capable of passing wellbore fluids and having an interior and exterior side;

a single inner eccentric sleeve rotatably coupled about said mandrel, said single inner eccentric sleeve having an eccentric longitudinal bore of sufficient diameter to allow free relative motion between said mandrel and said single inner eccentric sleeve, said single inner eccentric sleeve having an exterior side;

an outer housing rotatably coupled around said single inner eccentric sleeve, said outer housing having an eccentric longitudinal bore forming a weighted side adapted to automatically seek the low side of the wellbore and having sufficient diameter to allow free relative motion between said single inner eccentric sleeve, said outer housing having an outer surface co-located with an exterior;

a pair of stabilizer shoes longitudinally attached to said outer surface of said outer housing circumferentially at ninety degrees to each side of said weighted side of said outer housing;

drive means for selectively rotating said single inner eccentric sleeve with respect to said outer housing;

logic means for determining when said single inner eccentric sleeve should be rotated;

said single inner eccentric sleeve further having a first axial position and a second axial position with respect to said outer housing; and a series of drilling fluid passageways extending generally radially through said mandrel, said single inner eccentric sleeve and said outer housing such that, when said single inner eccentric sleeve is in said first position, said series of drilling fluid passageways align with each other so as to allow drilling fluid to flow readily from said interior of the said mandrel to said exterior of said outer housing accompanied by a relatively low pressure drop, and when said single inner eccentric sleeve is in said second position, said drilling fluid passageways are in misalignment so as to restrict drilling fluid flow from said interior of said mandrel to said exterior of said outer housing accompanied by relatively high pressure drop.

28. The apparatus of claim 27 further comprising an energy source for supplying power to said drive means and logic means.

29. The apparatus of claim 26 further comprising an energy source for supplying power to said drive means and logic means and wherein said logic means and said energy source are located within a separate housing connected to the combination of said mandrel, said single inner eccentric sleeve and said outer housing.

30. The apparatus of claim 26 wherein said mandrel has an interior, said outer housing has an exterior, and said single inner eccentric sleeve has a first axial position and a second axial position with respect to said outer housing, and wherein said signaling means comprises a series of drilling fluid passageways extending generally radially through said mandrel, said single inner eccentric sleeve and said outer housing such that, when said single inner eccentric sleeve is in said first position, said series of drilling fluid passageways align with each other so as to allow drilling fluid to flow readily from said interior of the said mandrel to said exterior of said outer housing accompanied by a relatively low pressure drop, and when said single inner eccentric sleeve is in said second position, said drilling fluid passageways are in misalignment so as to restrict drilling fluid flow from said interior of said mandrel to said exterior of said outer housing accompanied by relatively high pressure drop.

31. The apparatus of claim 26 wherein said drive means for selectively rotating said single inner eccentric sleeve further comprises electric motor means rotating said single inner eccentric sleeve within said outer housing in response to said logic means, wherein said apparatus is connected to a drill string, wherein said drilling parameters include drill pipe rotation and wherein said logic means includes means for detecting drill pipe rotation and determining a time period between rotation and non-rotation of the drill string wherein said time period determines when said single inner eccentric sleeve should be rotated with respect to said outer housing.

32. The apparatus of claim 26 wherein said drive means for selectively rotating said single inner eccentric sleeve further comprises electric motor means for axially positioning said single inner eccentric sleeve within said outer housing in response to said logic means, wherein said apparatus is connected to a drill string, wherein said drilling parameters include drill pipe rotation and wherein said logic means includes means for detecting drill pipe rotation and determining a time period between rotation and non-rotation of the drill string wherein said time period determines said axial position.

33. An apparatus for selectively controlling from the surface the drilling direction of an inclined wellbore comprising:

a hollow rotatable mandrel having a concentric longitudinal bore, said concentric longitudinal bore capable of passing wellbore fluids and having an interior and exterior side;

an inner sleeve rotatably coupled about said mandrel, said inner sleeve having an eccentric longitudinal bore of sufficient diameter to allow free relative motion between said mandrel and said inner sleeve, said sleeve having an exterior side;

an outer housing rotatably coupled around said inner eccentric sleeve, said outer housing having an eccentric longitudinal bore forming a weighted side adapted to automatically seek the low side of the wellbore and having sufficient diameter to allow free relative motion between said inner sleeve, said outer housing having an outer surface co-located with an exterior;

a pair of stabilizer shoes longitudinally attached to said outer surface of said outer housing circumferentially at ninety degrees to each side of said weighted side of said outer housing;

drive means for selectively rotating said inner eccentric sleeve with respect to said outer housing;

logic means for determining when said inner sleeve should be rotated;

said inner sleeve further having a first axial position and a second axial position with respect to said outer housing; and a series of drilling fluid passageways extending generally radially through said mandrel, said inner sleeve and said outer housing such that, when said inner sleeve is in said first position, said series of drilling fluid passageways align with each other so as to allow drilling fluid to flow readily from said interior of the said mandrel to said exterior of said outer housing accompanied by a relatively low pressure drop, and when said inner sleeve is in said second position, said drilling fluid passageways are in misalignment so as to restrict drilling fluid flow from said interior of said mandrel to said exterior of said outer housing accompanied by relatively high pressure drop.

34. The apparatus of claim 33 where a bit-jet and orifice combination is positioned within said generally radial passageway in said mandrel adjacent said inner sleeve.

* * * * *